US008382614B1

(12) United States Patent
Menk

(10) Patent No.: US 8,382,614 B1
(45) Date of Patent: Feb. 26, 2013

(54) GOLF BALL MARKER WITH FLIP UP SIGHT

(76) Inventor: John Menk, Kenyon, MN (US)

( * ) Notice: Subject to any disclaimer, the term of this patent is extended or adjusted under 35 U.S.C. 154(b) by 160 days.

(21) Appl. No.: 12/689,292

(22) Filed: Jan. 19, 2010

Related U.S. Application Data

(60) Provisional application No. 61/149,040, filed on Feb. 2, 2009.

(51) Int. Cl.
*A63B 57/00* (2006.01)

(52) U.S. Cl. ..... 473/406

(58) Field of Classification Search ..... 473/406, 473/285, 257, 268; D21/793, 794
See application file for complete search history.

(56) References Cited

U.S. PATENT DOCUMENTS

| | | | | | |
|---|---|---|---|---|---|
| 1,735,736 | A * | 11/1929 | Davidson | 473/406 |
| 2,107,944 | A * | 2/1938 | Willard | 473/406 |
| 3,041,071 | A * | 6/1962 | Fialon | 473/406 |
| 5,135,220 | A * | 8/1992 | Baldoni | 473/406 |
| 5,356,133 | A * | 10/1994 | Bellagamba | 473/406 |
| 5,437,446 | A * | 8/1995 | Youngkin | 473/406 |
| 5,755,629 | A * | 5/1998 | Blomgren | 473/408 |
| 5,795,249 | A * | 8/1998 | Johnson | 473/406 |
| 6,077,174 | A | 6/2000 | Noritake | |
| 6,386,995 | B1 * | 5/2002 | Jastram | 473/406 |
| 6,422,955 | B1 * | 7/2002 | Lopez | 473/406 |
| D520,588 | S * | 5/2006 | Morgan | D21/794 |
| D540,902 | S | 4/2007 | Regalado | |
| 7,438,652 | B2 * | 10/2008 | Kuroda | 473/406 |
| D583,893 | S * | 12/2008 | Ruff | D21/794 |
| 2006/0234813 | A1 * | 10/2006 | Kuroda | 473/406 |
| 2009/0247329 | A1 * | 10/2009 | Murken et al. | 473/406 |

OTHER PUBLICATIONS www.aspiring-golfer.com/scotty-cameron-ball-marker/ Jan. 26, 2009.

* cited by examiner

*Primary Examiner* — Steven Wong
(74) *Attorney, Agent, or Firm* — Brooks, Cameron & Huebsch, PLLC

(57) ABSTRACT

A method of marking the position of a golf ball on a putting green and assisting in aligning an ensuing putt of the golf ball. A marker is obtained. The marker comprises a thin object having a first major surface, a second major surface, and a peripheral edge. A segment of the object is pivotable relative to the balance of the object as between a first position in which the segment rests parallel with and within the same plane as the balance of the object and a second position in which the segment rests perpendicular to the balance of the object. The peripheral edge along the segment is conspicuously colored. The marker is placed proximate a golf ball on a putting green. The segment is pivoted from the first position to the second position. The marker is rotated as necessary to align the conspicuously colored edge of the segment resting in the second position with a predicted putting direction.

6 Claims, 2 Drawing Sheets

GOLF BALL MARKER WITH FLIP UP SIGHT

This application claims the benefit of U.S. Provisional Application No. 61/149,040, filed Feb. 2, 2009.

BACKGROUND

In the game of golf, the position of a golf ball on a putting green is typically marked by placing a ball marker, small coin or other similar object immediately behind the ball (USGA Rule 20-1). A golfer's accuracy is based upon his/her ability to predict the roll of the ball, the change of direction on the green and the outcome of by which direction to putt the ball. After a ball is marked, many golfers walk a green to determine the slope, undulations, and quickness to better improve their result for the upcoming golf stroke. In many cases, golfers practice swinging next to their ball mark, prior to placing their ball as well as next to their ball prior to making their stroke. To improve the outcome and direct their putting alignment, many players draw a line on the top center of the golf ball to better understand the impression of the direction and aim of the ball and the ball's final resting position.

Many devices exist to help golfers practice their swing and improve their putting. Virtually none of these devices are useable during an actual game of golf. Additional customs of drawing on the ball, specifically straight lines, help golfers during their golf game, but this custom's effectiveness is limited since a ball is often removed and marked.

Therefore, a need exists for a device that helps a golfer, during an actual golf game, to improve their accuracy of the putt by assisting in predicting proper alignment and "reading" of the direction of their ball.

SUMMARY OF THE INVENTION

A first aspect of the invention is a method of marking the position of a golf ball on a putting green and assisting in aligning an ensuing putt of the golf ball. The method includes the steps of (A) obtaining a marker comprising a thin object having a first major surface, a second major surface and a peripheral edge with (i) a segment of the object pivotable relative to the balance of the object as between a first position in which the segment rests parallel with and within the same plane as the balance of the object, and a second position in which the segment rests perpendicular to the balance of the object, and (ii) the peripheral edge along the segment is conspicuously colored, (B) placing the marker proximate a golf ball on a putting green, (C) pivoting the segment from the first position to the second position, and (D) rotating the marker as necessary to align the conspicuously colored edge of the segment resting in the second position with a predicted putting direction.

A second aspect of the invention is a golf ball marker comprising a low profile base with a flap. The base has a first major surface and a midsection. The flap has a colored edge. The flap is pivotable along an alignment axis located at the midsection of the base. The flap is pivotable between a closed position and an open position. When the flap is in the closed position the flap rests atop and parallel to the first major surface of the base. When the flap is in the open position it extends above and rests perpendicular to the first major surface of the base.

DETAILED DESCRIPTION OF A PREFERRED EMBODIMENT

Nomenclature

Figure 1:
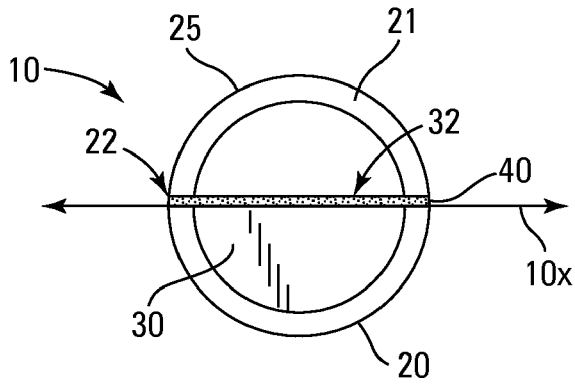
FIG. 1 is a top view of one embodiment of the golf ball marker with the flap in the closed position.

10 Golf Ball Marker
10*x* Alignment Axis of Marker
20 Base
20T Thickness of the Base
21 First Major Surface of the Base
22 Midsection
23 Second Major Surface of the Base
24 Diameter of the Base
25 Circumference of the Base
30 Flap
31 Edge of Flap
32 Hinge
40 Alignment Mark
100 Golf Ball Construction As shown in FIG. 1, one embodiment of the golf ball marker 10 has a low profile base 20 and a flap 30. The base 20 has a first major surface 21, a second major surface 23, a periphery 25, and a midsection 22. The base 20 may have any geometric shape. The preferred shape is circular. The remainder of the discussion will be based on a circular base 20 with a circumference 25 that is the same at both the first major surface 21 and the second major surfaces 23.

The base 20 has a thickness 20T between the first major surface 21 and the second major surface 23. Preferably the thickness 20T is less than 0.5 inches (12.7 mm). The most preferred thickness is 3.0 mm.

The diameter 24 of the base 20 may be any size allowing the marker 10 to be easily carried around by a golfer. Preferably the diameter 24 of the base 20 is two inches or less (i.e., a first major surface 21 of less than about 3 $in^2$). Most preferably the diameter 24 of the base 20 is 42 mm (i.e., a first major surface 21 of less than about 1386 $mm^2$).

The flap 30 is pivotable along an alignment axis 10*x* located at the midsection 22 of the base 20. The flap 30 may pivot using any known and acceptable pivoting mechanism. The most preferred pivoting mechanism is a hinge.

Figure 4:
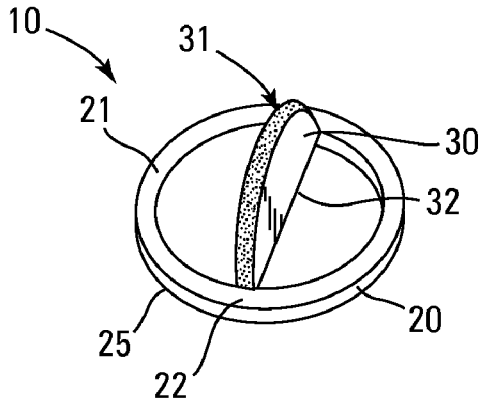
FIG. 4 is a top perspective view of the golf ball marker in FIG. 3.

The flap 30 may be hinged directly to the base 20 along the midsection 22 of the base 20 to allow the flap to pivot along the alignment axis 10*x*. As shown in FIG. 4 the preferred flap 30 has a hinge positioned along the alignment axis when the flap rests atop the first major surface of the base allowing the flap 30 to pivot. Most preferably the flap 30 has a live hinge allowing the flap 30 to pivot along the alignment axis 10*x*. As shown the curved edge of the flap has a radius of curvature less than a radius of curvature of the base. The flap defines a first and a second end defining a length that is less than a length of the diameter of the base. The hinged connection has a length less than the length of the diameter of the base. The flap and hinged connection are interior to the periphery of the base. The flap 30 may be held in the desired first or closed position and the second or open position by any of the various well known "catch" mechanisms ranging from magnetic attraction of properly shaped surfaces to a hinge biased towards the first or closed position with an interference fitting capable of overcoming the bias when the flap 30 is positioned in the second or open position.

Figure 2:
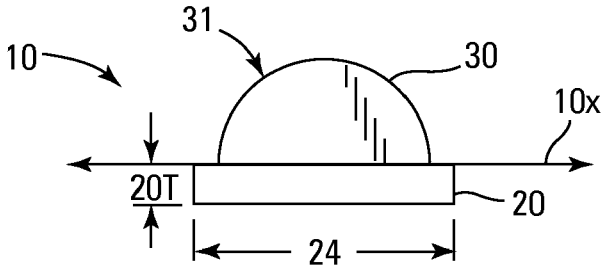
FIG. 2 is a side view of the golf ball marker in FIG. 1 with the flap in the open position.
Figure 3:
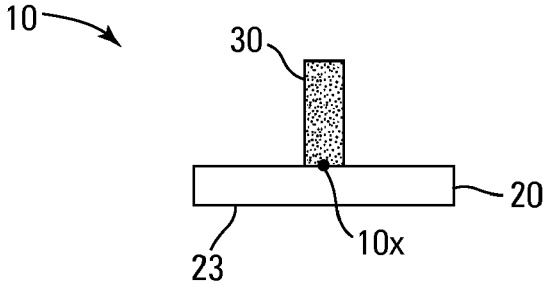
FIG. 3 is an end view of the golf ball marker in FIG. 2 showing the colored circumference of the flap.

The flap 30 is pivotable between a closed position and an open position. As shown in FIG. 1, the flap 30 rests atop and parallel to the first major surface 21 of the base 20 when in the closed position. As shown in FIGS. 2 and 3, the flap 30 extends above and rests perpendicular to the first major surface of the base 20 in the open position. Preferably the maximum height (not numbered) of the golf ball marker 10 in the second or open position is 6.3 mm. The edge 31 of the flap 30 may be colored or highlight so as to provide a more distinct sight line when in the open position. Preferably the colored edge 31 of the flap 30 is not visible when the flap 30 is in the closed position.

The base 20 may also have at least one linear alignment mark 40 on the marker 10 extending along the alignment axis 10*x*. The linear alignment mark 40 is preferably visible only when the flap 30 is in the closed position. Additional alignment marks 40 may also be on the marker 10 spaced from the midsection 22 of the base 20 to provide additional sights for the golfer.

The base 20 and flap 30 may be made from any suitable material such as metal, wood, or plastic. Preferably the base 20 and flap 30 are made from plastic.

Use

The golf ball marker 10 is preferably sized to easily fit in a golfer's pocket for use during practice or a golf game. Once a ball 100 is hit onto the green, the golfer may place the golf ball marker 10 in the closed position on the green just behind the golf ball 100 with the second major surface 23 of the base 20 lying on the putting green. The golf ball 100 may then be lifted off of the green to allow another player to putt. As the golfer is waiting his turn to putt he may consider options and angles for putting his ball 100 by looking at the golf ball marker 10 from the side of the putting green. As shown in FIG. 1, the linear alignment mark 40 on the marker 10 provides a sight for the golfer with out the marker 10 being an obstruction to the other golfers.

Figure 5:
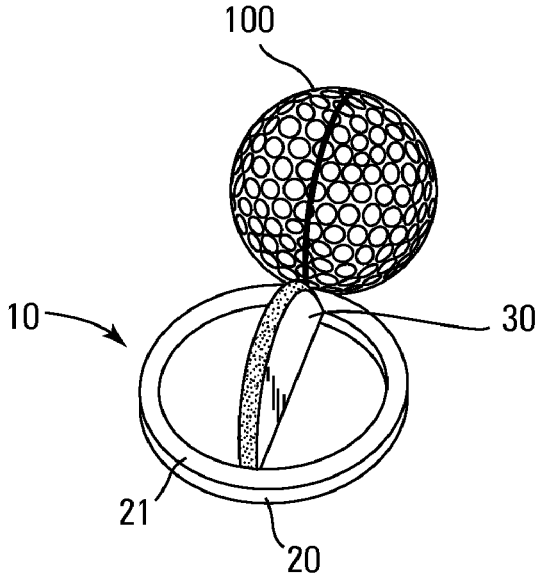
FIG. 5 is a top perspective view of the golf ball marker in FIG. 4 in use with a golf ball.

Once it is his turn to putt, the golfer pivots the flap 30 on the golf ball marker 10 into the open position exposing the colored edge 31 of the flap 30 providing an easily viewed sight. The golfer may then more easily "read" the green from a closer vantage point and determine how to place his ball 100 for putting. The marker 10 may be rotated to align the colored edge 31 of the flap 30 to the putting line the golfer wishes to make. The golfer may practice his swing with the marker 10 in the open position. The golfer may also practice putting with the flap 30 in the closed position using the linear alignment mark 40 on the marker 10. As shown in FIG. 5, once the golfer is finished with his practice swings, he may then place his ball 100 back onto the putting green. If the golf ball 100 has a ball line on it the ball line may be lined up with the flap 30 as shown in FIG. 5 or with the linear alignment mark 40. The marker 10 is removed from the green to allow the golfer to make his putt.

If the flap 30 is still in the open position it is pivoted back into the closed position. The golf ball marker 10 may be stored in the golfer's pocket or golf bag until needed again.

I claim:

1. A golf ball marker consisting of:

a low profile base having:

a first major surface;

an outer periphery; and a midsection; and a flap hingedly connected to the base along the midsection, having:

a curved edge colored perceptibly different than the base, wherein the curved edge has a radius of curvature less than a radius of curvature of the base;

a first and a second end, wherein a length between the first and second end is less than a length of a diameter of the base; and wherein the hinged connection has a length less than the length of the diameter of the base; and wherein the flap is pivotable along an alignment axis located at the midsection of the base wherein the flap is pivotable between a closed position in which the flap rests atop and parallel to the first major surface of the base, and wherein the flap and the hinged connection are interior to the outer periphery of the base, and an open position in which the flap extends above and rests perpendicular to the first major surface of the base.

2. The golf ball marker, as set forth in claim 1, wherein the colored edge of the flap is not visible when the flap is in the closed position.

3. A golf ball marker consisting of:

a low profile base having:

a first major surface;

an outer periphery; and a midsection;

a flap hingedly connected to the base along the midsection, having:

a curved edge colored perceptibly different than the base, wherein the curved edge has a radius of curvature less than a radius of curvature of the base;

a first and a second end, wherein a length between the first and second end is less than a length of a diameter of the base; and wherein the hinged connection has a length less than the length of the diameter of the base; and wherein the flap is pivotable along an alignment axis located at the midsection of the base wherein the flap is pivotable between a closed position in which the flap rests atop and parallel to the first major surface of the base, and wherein the flap and the hinged connection are interior to the periphery of the base, and an open position in which the flap extends above and rests perpendicular to the first major surface of the base; and a linear alignment mark on the marker extending along the alignment axis wherein the mark is visible when the flap is in the closed position.

4. The golf ball marker, as set forth in claim 1, wherein the flap is hingedly connected to the base with a live hinge.

5. The golf ball marker, as set forth in claim 1, wherein the base and flap are made from plastic.

6. The golf ball marker, as set forth in claim 1, wherein the base and flap are made from metal.

* * * * *